US005656579A

United States Patent [19]

Chambers et al.

[11] Patent Number: 5,656,579

[45] Date of Patent: Aug. 12, 1997

[54] TOILET SOAP BARS

[75] Inventors: John George Chambers; Geoffrey Irlam, both of Merseyside, Great Britain

[73] Assignee: Lever Brothers Company, Divison of Conopco, Inc., New York, N.Y.

[21] Appl. No.: 613,813

[22] Filed: Mar. 6, 1996

Related U.S. Application Data

[62] Division of Ser. No. 240,412, May 5, 1994, abandoned.

[30] Foreign Application Priority Data

May 7, 1993 [GB] United Kingdom ..... 9309442

[51] Int. Cl.[6] ..... C11D 9/30; C11D 9/48

[52] U.S. Cl. ..... 510/152; 510/152; 510/155; 510/141; 510/130

[58] Field of Search ..... 510/130, 141, 510/152, 153, 155

[56] References Cited

U.S. PATENT DOCUMENTS

| | | | |
|---|---|---|---|
| 3,494,869 | 2/1970 | Armstrong | 252/109 |
| 3,576,749 | 4/1971 | Megson et al. | 252/132 |
| 3,879,309 | 4/1975 | Gatti et al. | 252/117 |
| 3,988,255 | 10/1976 | Seiden | 252/107 |
| 3,991,001 | 11/1976 | Srinivasan et al. | 252/117 |
| 4,303,543 | 12/1981 | Mansy | 252/117 |
| 4,861,507 | 8/1989 | Gervasio | 252/108 |
| 4,919,838 | 4/1990 | Tibbetts et al. | 252/117 |
| 4,946,618 | 8/1990 | Knochel et al. | 252/117 |
| 4,985,170 | 1/1991 | Dawson et al. | 252/117 |
| 4,988,453 | 1/1991 | Chambers et al. | 252/117 |
| 5,028,353 | 7/1991 | Simion et al. | 252/121 |

FOREIGN PATENT DOCUMENTS

| | | |
|---|---|---|
| 0194126 | 10/1985 | European Pat. Off. . |
| 0311343 | 4/1989 | European Pat. Off. . |
| 0363215 | 4/1990 | European Pat. Off. . |
| 2182343 | 5/1987 | United Kingdom . |
| 2243614 | 4/1990 | United Kingdom . |
| 2243614 | 11/1991 | United Kingdom . |
| 93/04161 | 3/1993 | WIPO . |

OTHER PUBLICATIONS

Co-pending application Chambers et al. -S/N 08/240,947 -Filed May 5, 1994.

*Primary Examiner*—Paul Lieberman
*Assistant Examiner*—Necholus Ogden
*Attorney, Agent, or Firm*—Ronald A. Koatz

[57] ABSTRACT

The invention relates to mild toilet soap bars, comprising blends of soap with one or more coactives. There is a need for mild bars which do not have the processing problems associated with the use of superfatting agents and co-actives, which can be made without difficulty on conventional soap production lines without substantial modification of the lines and yet provide a product with reduced harshness while maintaining lathering and structural properties. Moreover, it is desirable that soap bars should not suffer from the defect of grittiness and also have a composition which contains relatively low levels of the significantly more expensive lauric fats. We have determined that in soap bars which comprise at least 25% wt. on total actives of lauric acid soaps; as the balance of the soaps, non-lauric soaps having an iodine value of less than 45; at least 5% wt. on total actives of one or more synergistic mildness active, and, 2–10% on total actives of free fatty acids and are substantially free of cationic polymer skin mildness aids, there is a significant reduction in bar stickiness while maintaining hardness within acceptable limits. Moreover, the lather volume of the bars is increased without the addition of lauric fats and they do not suffer from grittiness.

12 Claims, No Drawings

TOILET SOAP BARS

This is a divisional application of Ser. No. 08/240,412, now abandoned, filed May 5, 1994.

FIELD OF THE INVENTION

The present invention relates to toilet soap bars, particularly to mild toilet soap bars comprising blends of soap with one or more coactives.

BACKGROUND OF THE INVENTION

For very many years soap bars have been manufactured from fats by conversion of triglyceride components of fats into fatty acid salts and the formation of these 'soaps' into bars.

Traditionally, the most important fats used in soap manufacture have been tallow (a palmatic/stearic fat rendered from animal carcasses) and coconut oil (a lauric fat). For the purposes of this specification the words 'oil' and 'fat' are considered interchangeable except where the context demands otherwise. The use of other palmitic/stearic fats such as palm oil and alternative lauric fats such as palm kernel, babassu or macauba oil is known.

In general the longer chain fatty acid soaps, particularly the less expensive C16 and C18 soaps (as obtained from tallow and palm oils) provide structure in the finished soap bars and prevent or retard disintegration of the soap bar on exposure to water.

The more expensive, shorter chain, lauric fat-derived, (i.e. lauric acid salts) and other soluble soaps (typically as obtained from coconut and palm kernel oil) contribute to the lathering properties of the overall composition.

A general problem in the formulation of bar soaps has been that of finding a balance between providing structure (generally obtained from the cheaper tallow/palm component) and maintaining lathering properties (generally obtained from the more costly coconut oil component) at a practical overall cost.

The fatty acid chain length distribution of a range of soap components is given below:

| Chain length | Tallow | Palm | Coconut | Palm Kernal |
|---|---|---|---|---|
| 10 | 0.1 | 0.0 | 15.1 | 6.4 |
| 12 (lauric) | 0.1 | 0.3 | 48.0 | 46.7 |
| 14 | 2.8 | 1.3 | 17.5 | 16.2 |
| 16 (palmitic) | 24.9 | 47.0 | 9.0 | 8.6 |
| 18 (stearic) | 20.4 | 4.5 | 9.0 | 8.6 |
| 20 | 1.8 | 0.3 | 0.0 | 0.4 |
| 18:1 (oleic) | 43.6 | 36.1 | 5.7 | 16.1 |
| 18:2 | 4.7 | 9.9 | 2.6 | 2.9 |
| 18:3 | 1.4 | 0.2 | 0.0 | 0.0 |
| Poly unsat | 0.1 | 0.0 | 0.0 | 0.0 |

From the table it can be seen that the coconut and palm kernel fats (together known as the lauric fats) are particularly rich in the C10–C14 saturated fatty acids, particularly fatty acid residues derived from lauric acid itself. For convenience these fats, containing saturated, relatively short chain fatty acids, will be referred to hereinafter as the 'lauric' fats. This definition includes the coconut, palm kernel, babassu or macauba oils as mentioned above. In contrast, tallow and palm oil per se are an industrial source of non-lauric fats, especially those containing C16 and C18 fatty acid residues: both saturated and unsaturated residues being present in almost equal quantities. The C16 and C18 fatty acids, together with the longer chain fatty acid are referred to herein as 'non-lauric' fats.

A standard measure of the degree of saturation of a fatty acid residue, or more usually of a blend of fats or fatty acids, is the so-called iodine value. The iodine value of a fatty acid residue is determined by the ability of the residue to bind iodine expressed in Mole %. Iodine binds to unsaturated fatty acids in proportion to the extent of the unsaturation and does not bind in the same manner to saturated fats. Consequently, saturated fats have low iodine values, mono unsaturated fats bind around 100 Mole % iodine and have iodine values ('IV') of around 100. In contrast di-unsaturated fats bind around 200 Mole % and have iodine values approaching 200. The 63rd Edition of the CRC Handbook (CRC Press) gives the iodine value of beef tallow as 49.5, and for coconut oil gives an iodine value of 10.4.

In typical commercial formulations, soap bars contain from 90–50% fatty acid soaps obtained from tallow (i.e. non-lauric fats) and 10–50% of fatty acid soaps obtained from coconut (i.e. lauric fats). In particular, in countries where tallow is acceptable to consumers, most commercial soap formulations comprise 80% tallow and 20% coconut oil. In countries where tallow is unacceptable other non-lauric oils and fats, such as palm oil, replace tallow.

Some typical formulations are disclosed in the patents mentioned below:

GB 989007 (Procter & Gamble) discloses several formulations which comprise 24–33% coconut soap. The balance of the soaps in these formulations (around half the total soaps) are generally tallows (non lauric soaps) with I.V. around 48. Some hardened non-laurics are present at up to a level of 5%.

EP 194126 (Procter & Gamble) discloses omega-phase soap formulations with a 50/50 coco/tallow fat charge of an I.V. about 25. The fats are described as comprising 'touch-hardened' tallow/coconut fatty acid blends, i.e. no substantial hydrogenation of the fats has taken place. The I.V. of tallow is normally about 50, and coconut about 10 therefore a total I.V. of 25 is not inconsistent with the use of these materials. Touch-hardening is a well known technique used to improve the keepability of oils and fats by removing oxidation sensitive components and consequently delaying the onset of rancidity.

WO 84/04929 (Henkel) discloses a soap bar comprising at least 40% lauric acid soaps. The examples disclose formulations with coconut fatty acid soaps of the 'Edenor' [RTM] type.

In addition to fatty acid soaps per se, toilet bars can contain free fatty acid. The addition of free fatty acid is known as 'superfatting' and superfatting at a 5–10% free fatty acid level is known to give a copious, creamy lather. Other superfatting agents include citric and other acids which function by promoting the formation of free fatty acids in the fat blend.

The conventional soap making process as applied to the manufacture of toilet soaps is well documented in the literature. In outline the process is as follows. In conventional 'wet' soap making, fats, i.e. tallow and coconut oil blends, are saponified in the presence of an alkali (typically NaOH) to yield fatty acids as alkaline soaps and glycerol. The glycerol is extracted with brine to give a dilute fatty acid soap solution containing around 70% soap and 30% aqueous phase. This soap solution is dried, typically by heating in heat exchangers to circa 130° C. and drying under vacuum, to a water content of around 12%, and finished by milling, plodding and stamping into bars.

One known defect in soap bars is so-called 'grittiness' It is believed that grittiness is caused by overdrying of a portion of the soap during the vacuum drying stage which leads to a poor barfeel. The problem of grittiness becomes progressively more significant at lower water contents and while grittiness can be controlled at laboratory scale it is more difficult to prevent grittiness at pilot plant and factory scale.

The stamping step, is typically conducted at around 250 or more bars per minute in a conventional soap line having several bars stamped in parallel.

A problem commonly encountered in stamping of bars is so-called 'die-blocking'. This occurs when a billet of soap does not release from the die after the stamping operation. The consequence of die blocking is that the process line must be stopped and the die cleared manually. This has a serious effect on throughput, as it is difficult to stop, clear and restart the stamping apparatus quickly and safely. During this down-time, the soap being produced upstream of the stamping apparatus must be diverted and recycled.

In general, superfatting of bars makes the bars softer and more difficult to process, particularly in the plodding and stamping step. For this reason, superfatted bars are processed at a low water content: typically 82% total fatty matter (TFM) as opposed to the more conventional 78% TFM. If conventional water contents are used, superfatted bars are difficult to manufacture. Preferably superfatted bars are manufactured at a low temperature to increase the hardness of the billets and to reduce adhesion of the billets to the dies (see Woollatt: 'The manufacture of soaps, other detergents and glycerine', page 267, paragraph 6.5.6). As will be appreciated, the decrease in the water content of the bars associated with superfatting increases the cost of the bars as the proportion of fatty matter in the bars is increased.

A further drawback of compositions containing fatty acid soap is harshness, a property which is determined by a number of tests as will be elaborated upon hereafter. Known solutions to the problem of harshness include reduction of the level of soap present and replacement of the balance of the composition by so-called co-actives. It has also been suggested that superfatting improves mildness but the improvement is not considered as significant as that obtained by the use of co-actives. As with superfatting agents, a recognized problem engendered by the presence of co-actives is a loss of product structure in the resulting soap bars.

WO 93/04161 (Procter & Gamble) discloses bars which comprise a mixture of soap, a $C_{14}$–$C_{20}$ alkyl polyethoxylate nonionic detergent surfactant and a $C_{10}$–$C_{18}$ acyl isethionate. The soap contains at least tallow and is often a mixture with palm stearin and/or coconut. Also included in the formulations are cationic polymeric skin mildness aids and, as moisturizers, free fatty acids.

In order to overcome the problem of loss of structure, soap bars which comprise co-actives have been manufactured by processes which, while being successful, increase the cost of the eventual products. Several such processes are known.

GB 2182343-A (Procter & Gamble) discloses toilet soaps comprising a fatty acid soap, a synthetic surfactant co-active and a water soluble polymer. In order to reduce the softening effect of the co-active it is necessary for some of the soap to be present in the so-called beta-crystalline phase and crystallization in this phase can only be achieved by the application of high shear (i.e. energetic working) in an additional processing step after the drying step and prior to finishing.

EP 363215 (Colgate) discloses the production of toilet soap bars from soap and an ethoxylated surfactant co-active. This soap composition needs to be dried to below a critical 5% wt moisture content in order to harden the material sufficiently for processing into bar form using conventional soap making/forming equipment. This drying step requires additional equipment in the form of batch drying trays to be used prior to soap finishing.

EP 311343 (Procter & Gamble) discloses the combined use of a beta-crystalline phase, an ethoxylated nonionic surfactant co-active and a water soluble polymer. As described above, these compositional modifications require modification of the soap processing line to provide for the energetic working needed to form the beta-crystalline phase.

GB 2243614 (Proctor & Gamble) discloses a beta-phase soap bar prepared by a process involving the use of one or more mills (see page 13 line 30ff). The bars have less than about 25% short chain soaps (see page 4 line 37ff) as the presence of these soaps interferes with the formation of the beta-phase.

It can be seen from the foregoing that each of the known, alternative processes for the production of soap bars containing co-actives require the provision of further processing apparatus, particularly in the form of drying and/or energetic working apparatus and the additional processing step which makes use of this apparatus prior to soap finishing. This increases the cost of processing and consequently increases the cost of the bars produced.

In addition to provision of structure, it is known that the beta-phase of soap provides translucency in certain formulations. It is also known that these formulations cannot contain significant quantities of superfatting agents (at or above 2% wt) as the presence of larger quantities of superfatting agent interferes with the formation of the beta phase.

From the above it can be seen that there is a need for mild bars which do not have the processing problems associated with the use of superfatting agents and co-actives, which can be made without difficulty on conventional soap production lines without substantial modification of the lines and yet provide a product with reduced harshness while maintaining lathering and structural properties. It is desirable that soap bars should not suffer from the defect of grittiness and it is also desirable that these bars have a composition which contains relatively low levels of the significantly more expensive lauric fats.

BRIEF DESCRIPTION OF THE INVENTION

The present invention provides such a composition and subsists in the combined use of relatively more highly saturated long chain soaps, i.e. relatively less unsaturated long chain soaps than in conventional soap compositions, and both a co-active and a superfatting agent. It is surprising that superfatting agents should lead to advantages when it is known that these agents normally present problems in bar processing.

Accordingly, the present invention include soap bars which comprise:

a) At least 25% wt on total actives of lauric acid soaps,
b) As the balance of the soaps, non-lauric soaps having an iodine value of less than 45,
c) At least 5% wt on total actives of one or more synergistic mildness active, and
d) 2–10% on total actives of free fatty acids; and is substantially free of cationic polymeric skin mildness aids.

Surprisingly, we have determined that formulations according to the present invention significantly reduce bar stickiness while maintaining hardness within acceptable limits. Moreover, the lather volume of the embodiments of the invention is increased without the addition of lauric fats, and bars according to the present invention have less grittiness than those according to the prior art.

Soaps

Soaps are an essential component of the present invention. It is essential that the compositions of the present invention comprise at least 25% wt on total actives of lauric acid soaps.

As mentioned above, lauric acid soaps promote lathering and are characterized by a fatty acid composition containing a high proportion, particularly 65–80% on fatty acid content, of C10–C14 saturated acids. In the context of the present invention suitable sources of lauric fatty acids include:-coconut oil/fatty acid, palm kernel oil/fatty acid, babassu oil/fatty acid, macauba oil/fatty acid and mixtures thereof. The fats and fatty acids derived from coconut are preferred due to availability.

The balance of the soaps comprises non-lauric soaps having an iodine value of less than 45.

Suitable non-lauric soaps are consequently those rich in saturated fatty acids having a chain length greater than C14. Sources of such fatty acids include animal fats/fatty acids, e.g. tallow and lard and the fatty acid derived therefrom, and also vegetable derived oils, particularly fats/fatty acids rich in palmitic and stearic acid such as palm oils and fractions thereof. Where fatty acids are derived from oil-sources yielding fatty acids with a high degree of unsaturation, such as soya bean oil, sunflower oil, rice bran oil, linseed oil, rapeseed oils, ground nut oil, marine oils and the like, the oil stocks are preferably hardened or fractionated to yield partially or fully hardened fatty acid mixtures and or stearines. The fats and fatty acids derived from tallow are preferred except where nut-oil or other vegetable substitutes are employed for cultural reasons.

The preferred upper limit of the lauric acid soaps is about 60%, for reasons of economy.

In preferred embodiments of the invention the iodine value of the non-lauric soaps ranges from 10 to 45, is more preferably 20 to 40, and most preferably in the range 25 to 40. For conventional soap blends of tallow and coconut oil the iodine value of the non-lauric soaps is measured at around 48 (similar to the quoted value for pure tallow), it can therefore be seen that the non-lauric fats of the compositions of the present invention are, in general, more saturated that those employed in conventional soap making.

While single oils or rather fatty acid soaps derived therefrom, may be employed as components of the formulations according to the invention the use of mixtures or two or more oils and/or fatty acid compositions is not hereby excluded and, in practice, will be more commonplace.

As mentioned above, in compositions according to the present invention the ratio of saturated to unsaturated fatty acids in the non-lauric soaps has been shifted in favor of the saturated fatty acids. This can be accomplished by the addition of saturates to the soap blend or the removal or unsaturates. It is particularly preferable that a relative increase in the level of saturates is accomplished by the removal of oleic soaps. The oleics are the soluble C18:1 (oleic) and C18:2 (linoleic) soaps in tallow and palm and removal of these increases the overall saturate content.

Overall for the soaps, the iodine value of the soap blend will generally be less than 35 taking into account both lauric and non-lauric components.

Superfatting Agent

Free fatty acid, as a superfatting agent is an essential component of the compositions according to the present invention at a level of 2–10% on total actives.

This level of free fatty acids can be obtained by the addition of free fatty acids per se or by the addition of a non-fatty acid superfatting agent which protonates a portion of the fatty acid soaps present to form the free fatty acid.

Suitable fatty acid superfatting agents include tallow, coconut, palm and palm-kernel fatty acids. Other fatty acids can be employed although the low melting point fatty acids, particularly the laurics, are preferred for ease of processing. Preferred levels of fatty acid are 3–8%, most preferably around 5% on total actives.

Suitable non-fatty acid superfatting agents include organic or inorganic acids such as citric acid and phosphoric acid. These acids are typically used at a level of 1–2wt % on total actives. Citric acid is preferred to phosphoric acid as the citrate formed is not a strong salting-out agent and has less deleterious effect on the processing.

Surprisingly, we have found that the addition of superfatting agents widens the process window for the drying step, and reduces the tendency to form grit. In addition, the presence of superfatting agents reduces the incidence of billet/die adhesion and improves stamping throughput.

Synthetic Anionic Actives

In particular embodiments of the present invention the composition further comprises at least one synthetic anionic active at a level of not more than 20% wt, preferably at a level of not more than 10% wt, most preferably at a level of not more than 6% wt on the total active content of product.

In embodiments of the present invention the overall soluble active inventory should be in the range 50–70% wt, based on a normalized total active content of 100% wt and classing saturated soaps with a carbon chain length of less than 16, unsaturated soaps, synthetic anionic actives and synergistic mildness actives within the soluble active component inventory.

Synergistic Mildness Active

It is essential that the compositions of the present invention comprise at least 5% wt on total actives of one or more synergistic mildness active.

Preferably, the synergistic mildness active is selected from the group consisting of nonionic surfactants, amphoteric surfactants and mixtures thereof. The synergistic mildness active should be present at a level of at least 5% wt of the total active level. Particularly useful compositions comprise 5–25% wt, preferably 8–20% wt, more preferably 9–18% wt of synergistic mildness active on total actives.

Suitable nonionic surfactants include:-polyethoxylated alcohols, polyethoxylated alkyl phenols, alkyl polyglycosides, sorbitan esters, polysorbates, alkanolamides, poloxamers, and mixtures thereof. Preferred amongst the nonionic surfactants are polyethoxylated alcohols, particularly tallow ethoxylates. The preferred tallow ethoxylates have an average alkyl chain length of 10–20 carbons and an average ethoxylate content of 3–20 units.

Suitable amphoteric surfactants include:-amine oxides, aminimides, betaines, amido betaines and sulphobetaines, and mixtures thereof. Cocoamidopropyl betaines and tegobetaines are particularly preferred due to their low potential nitrosamine-precursor content.

As mentioned above the composition preferably comprises one or more synthetic anionic actives. Suitable synthetic anionic actives include:-alkyl sulphates, alkyl ether sulphates, alpha-olefin sulphonates, fatty isethionates, alkyl glyceryl ether sulphonates, mono-alkyl glyceryl sulphates, alkyl sarcosinates, alkyl taurides, alkyl sulphosuccinates, alkyl phosphates, and mixtures thereof. Preferred amongst the anionic actives are sodium lauryl ether sulphate (SLES), alpha-olefin sulphonates and sodium fatty isethionates. Sodium lauryl ether sulphate (SLES) is particularly preferred.

Preferred compositions according to the present invention have a 'lathering ratio' greater than 0.56, preferably greater than 0.6, more preferably greater than 0.8. The lathering ratio is defined as the sum of the saturated soaps with carbon chain lengths less than 16 plus the synthetic anionic actives divided by the sum of the unsaturated soaps plus the synergistic mildness actives. As noted above, the synergistic mildness actives can be either nonionic surfactants, amphoteric surfactants and mixtures thereof. In consequence for the vast majority of formulations, the lathering ratio can be written as L/LL where:

L:=$C_{8-14}$ :0+synthetic anionic actives

LL:=unsaturated soaps+nonionics+amphoterics

For conventional '80/20' soap formulations based on tallow and coconut oil (free of synthetic anionic actives, nonionics and amphoterics) the ratio L/LL is about 0.45.

Water Content

In embodiments of the present invention the total water content of the soap bar should be in the range 8–20% wt of the soap bar, preferably 9–17% wt, more preferably 10–16% wt. The most preferred level of water in the final bar is a normal water content for soap bars (around 12% of the bar) hence conventional driers can be used to achieve this level.

Surprisingly, we have determined that the use of a superfatting agent in the formulations of the present invention does not require the water content to be reduced as described in Wollatt. We have found that the billets obtained by practice of the present invention are less sticky than those obtained in the absence of the free fatty acid in the composition. A further, advantage associated with the presence of a superfatting agent in the compositions of the present invention is a decreased tendency to form 'grit' during the drying stage.

Salt Content

The salt content of the bars can vary. In practice the salt level will lie between 0 and 1.5% on product. Some or all of this salt can be residue from the saponification processes typically employed in soap making, as is known in the art. It is also known that the level of salt can have some slight influence on the eventual hardness of the product. This variation modifies the hardness of the soap bars and can be used to control the final hardness within production limits. It is preferred that the salt content lies between 0.2–0.8 wt % on product.

The most preferred compositions according to the present invention obey all the formulation rules given above: i.e. these blends comprise:

a) 25–60% wt on total actives of lauric acid soaps;
b) as the balance of the soaps, non-lauric soaps having an iodine value in the range 10–45;
c) 5–20% wt on total actives of one or more synergistic mildness active;
d) 50–70% wt on total actives of saturated soaps with a carbon chain length of less than 16, unsaturated soaps, optional synthetic anionic actives and synergistic mildness actives;
e) a ratio of greater than 0.56:1, of L:LL wherein:
   L:=saturated soaps with carbon chain lengths less than 16 plus the optional synthetic anionic actives, and,
   LL:=unsaturated soaps plus the synergistic mildness actives;
f) 2–10% on total actives of free fatty acids; and is substantially free of cationic polymeric skin mildness aids.

Minors

In addition to the essential and optional ingredients mentioned above, compositions according to the present invention may comprise one or more of the following optional ingredients: preservatives, perfumes, colors, opacifiers and optical brighteners, germicides and other medicinal ingredients.

Typical preservatives include substances which negate or reduce the adverse catalytic effects of heavy metals, particularly iron and copper. These preferably comprise organic sequestrants, such as EDTA or NTA. However it is known that high levels of EDTA can form colored complexes with iron and it is therefore commonplace to use EHDP (ethane-1-hydroxy-1,1-diphosphonic acid) in admixture with EDTA. Preferred levels of preservative are generally in the range 0.01–0.1% wt on product. Typical opacifiers include titanium dioxide, preferably at levels of around 0.2–0.4% wt on product.

Process

Having regard to process aspects a further aspect of the present invention provides a process for the manufacture of soap bars from neat soap which comprises the steps of:

a) preparing a neat soap comprising non-lauric fatty acid soaps having an iodine value of less than 45 and lauric fatty acid soaps, preferably such that the overall iodine value is less than 35,
b) combining the product of step (a) with one or more synergistic mildness actives and superfatting agents and drying to obtain a blend comprising at least 5% wt on total actives of synergistic mildness active, 2–10% on total actives of free fatty acids, at least 25% wt on total actives of lauric acid soaps and 8–20wt % moisture, and,
c) finishing the soap without energetic working to obtain soap bars.

It should be noted that in step (b) drying can precede the combination of ingredients or can follow the combination of ingredients. A further alternative is that the combination of ingredients takes place during the drying process, i.e. after the completion of a first drying stage, e.g. after the heat exchangers but before the vacuum drying step.

Conveniently, the finishing step (c) comprises the conventional steps of milling, plodding and stamping.

In order that the present invention can be better understood it will be illustrated hereafter by way of non-limiting examples.

EXAMPLES

The following materials were used in the preparation of products according to the present invention with formulations as given in Tables 1 and 2 below:

| | |
|---|---|
| Tallow Soap: | Hardened tallow fatty acid soaps having an iodine value of 38. (made in house), |
| Coco Soap: | Unhardened coconut fatty acid soap. (commercially available), |
| Nonionic: | Table 1: GENAPOL-T200 [RTM ex. Hoechst], tallow 20 EO, ethoxylated fatty acid, as synthetic mildness agent, Table 2: $C_{12}$–$C_{18}$ alcohol ethoxylate with 20 EO. |
| Coco Acid: | Coconut fatty acid [ex. Unichema], superfatting agent, |
| Perfume: | Commercial perfume |
| Opacifier: | Tiona AC [RTM ex. SCM chemicals], $TiO_2$ |
| Antioxidant: | EDTA (as tetrasodium salt) and ethane-1-hydroxy-1,1-diphosphonic acid. |

Compositions as given in Tables 1 and 2 were prepared as follows:

a) a neat soap was prepared comprising hardened non-lauric fatty acid soaps (tallow soap) and lauric fatty acid soaps (coco soap), at a temperature of 85° C.,
b) the product of step (a) was combined with the nonionic and the superfatting agents,
c) the product of step (b) was dried, and perfume and opacifiers added using a conventional ribbon mixer, d) the product of step (c) was milled, plodded and stamped into bars using conventional equipment.

Products were assessed as regards lather volume, stickiness, grit and hardness.

Lather volume was assessed by a handwash method which closely approximates normal consumer habit. The test involves the use of 20 untrained volunteers. Each volunteer wears a pair of surgical gloves and lathers the bar in a still body of water a temperature of 30° C. The volume of the lather produced is measured by submersion of the panelists hands under a calibrated collecting funnel.

Stickiness is scored on a ten point scale with ten representing a requirement that the dies need lubricated for every bar stamped, and 1 indicating that lubrication is needed after stamping every tenth bar. A score of zero indicates that no die lubrication was required.

Hardness was assessed using a sectilometer according to the method specified in Woollatt (cit. ultra) at page 259, to give harness in $10^5$ $N.m^{-2}$. The minimum acceptable hardness value for processing of soap bars is around 2.0.

Grit was assessed subjectively by a panel of 10 trained operators on a scale of 1–5, with 1 representing smooth bars, 2: slightly sandy, 3: sandy, slightly gritty, 4: gritty and 5: very gritty. The bars were first plunged into water at 20° C. and rotated in the hand for 30 seconds before an assessment was made.

TABLE 1

| Example | 1 | 2 | 3 | 4 |
|---|---|---|---|---|
| Tallow Soap | 41.1 | 36.7 | 44.1 | 41.7 |
| Coco Soap | 36.7 | 41.1 | 31.4 | 36.1 |
| Nonionic | 9.6 | 9.6 | 9.4 | 9.4 |
| Coco Acid | — | — | 3.8 | 3.8 |
| Perfume | 1.4 | 1.4 | 1.4 | 1.4 |
| Opacifier | 0.3 | 0.3 | 0.3 | 0.3 |
| Antioxidant | 0.04 | 0.04 | 0.04 | 0.04 |
| Water | | | to 100% | |
| Total Coconut | 36.7 | 41.1 | 35.2 | 39.9 |
| Lather Volume | 39 | 39 | 52 | 55 |
| Stickiness | 5 | 10 | 1 | 1 |
| Hardness | 2.9 | 2.9 | 2.7 | 2.8 |
| Grit | — | 2.6 | 1.0 | — |

Examples 1 and 2 are comparative examples which do not contain the superfatting agent. Both of these compositions contain relatively high levels of coconut fatty acid soaps as compared with typical soap bars and consequently, would be expected to give a high lathering product with some mildness benefit. However, the cost of raw materials would be higher than for conventional bars containing lower levels of coconut fatty acid soaps.

Example 3 and 4 contain the superfatting agent. In Example 3, an embodiment of the invention, a significantly less coconut fatty acids (as soap or superfatting agent) is present as compared with Examples 2 and 4. In Example 4, a total coconut level similar to that used in Example 2 has been employed.

From the results it can be seen that, the presence of the superfatting agent significantly reduces bar stickiness while maintaining hardness within acceptable limits. It can also be seen that the lather volume of the embodiments of the invention has been significantly increased without the addition of further lauric fats, and in the case of example 2, the lowest level of coconut fats or fatty acid has resulted a very high lather volume. Moreover, it is clear that the bars according to the present invention have less grittiness than those according to the prior art.

For conventional soap bars, containing 20% coconut soap/80% tallow soap, typical lather volumes would be 35–40, and the hardness would be around 2.5. Stickiness for these known bars would approach zero as far fewer processing problems are encountered in the manufacture of these low-coconut bars.

| Example | 5 | 6 | 7 | 8 | 9 | 10 | 11 |
|---|---|---|---|---|---|---|---|
| Tallow Soap | 44.9 | 43.6 | 43.1 | 43.0 | 41.5 | 35.3 | 69.6 |
| Coco Soap | 32.5 | 31.5 | 31.2 | 31.1 | 30.1 | 39.8 | 17.4 |
| Non-ionic | 9.7 | 9.4 | 9.3 | 9.2 | 8.9 | 9.3 | 0 |
| Coco Acid | 0 | 1.9 | 3.7 | 5.6 | 7.2 | 0 | 0 |
| Perfume /minors | 1.7 | 1.7 | 1.7 | 1.7 | 1.7 | 1.7 | 1 |
| Water | | | | to 100% | | | |
| Lather Volume | 34.7 | 36.0 | 56.0 | 54.7 | 59.9 | 51.3 | 44.3 |
| Grit | 1.9 | — | 1.0 | — | — | 2.6 | 1.8 |
| Stick-iness | 5 | | 1 | | | 10 | <1 |

Examples 5, 10 and 11 are comparative examples.

The results demonstrate that an increase in the level of coconut level in the composition produces an increase in lather volume.

However, high levels of coconut also result in an unacceptable increase in grit (see example 10) and an increased incidence of die blocking. As can be seen from a comparison of examples 7 and 10, not only does the addition of a fatty acid improve lather volume but it also improves processability of bars by reducing the grit score and the incidence of die blocking.

We claim:

1. Soap bar composition consisting essentially of:

a) at least 25% wt. on total actives of lauric acid soaps;

b) as the balance of the soaps, non-lauric soaps having an iodine value of less than 45;

c) at least 5% wt. on total actives of one or more synergistic mildness active selected from the group consisting of nonionic surfactants, amphoteric surfactants and mixtures thereof; and, d) 2–10% on total actives of free fatty acids; wherein said bar is free of cationic polymeric skin mildness aids; and wherein said bar is prepared using a conventional soap-making process which process does not utilize an energetic workup step, an additional drying step or equipment which is needed to implement these steps.

2. Soap bar according to claim 1 wherein the iodine value of the non-lauric soaps ranges from 25 to 40.

3. Soap bar according to claim 1 wherein the iodine value of the soap blend is less than 35 taking into account both lauric and non-lauric components.

4. Soap bar according to claim 1 comprising 3–8% free fatty acids.

5. Soap bar according to claim 1 further comprising at least one synthetic anionic active at a level of not more than 20% wt, of the total active content.

6. Soap bar according to claim 1 wherein the overall soluble active inventory is in the range 50–70% wt., based on a normalized total active content of 100% wt. and wherein the following components are classified within the class of soluble active inventory: saturated soaps with a carbon chain length of less than 16, unsaturated soaps, any synthetic anionic actives and synergistic mildness actives.

7. Soap bar according to claim 1 comprising 8–20% wt of synergistic mildness active on total actives.

8. Soap bar according to claim 1 wherein the lathering ratio is greater than 0.56, said ratio being defined as the sum of the saturated soaps with carbon chain lengths less than 16 plus the synthetic anionic actives divided by the sum of the unsaturated soaps plus the synergistic mildness actives.

9. Soap bar according to claim 1 comprising 10–16% wt water.

10. Soap bar composition according to claim 1 comprising: 25–60% wt. on total actives of lauric acid soaps;

a) at least 25% wt. on total actives of lauric acid soaps;

b) as the balance of the soaps, non-lauric soaps having an iodine value in the range 10–45;

c) 5–20% wt. on total actives of one or more synergistic mildness actives selected from the group consisting of nonionic surfactants, amphoteric surfactants and mixtures thereof;

d) 50–70% wt. on total actives of saturated soaps with a carbon chain length of less than 16, unsaturated soaps, optional synthetic anionic actives and synergistic mildness actives;

e) a ratio of greater than 0.56:1, of L:LL wherein: L=saturated soaps with carbon chain lengths less than 16 plus the optional synthetic anionic actives; and, LL:=unsaturated soaps plus the synergistic mildness actives; and, f) 2–10% on total actives of free fatty acids; wherein said bar is free of cationic polymeric skin mildness aids; and wherein said bar is prepared using a conventional soap-making process which process does not utilize an energetic work-up step, an additional drying step or equipment which is needed to implement these steps.

11. Soap bar according to claim 1 in the form of a stamped tablet.

12. A process for the manufacture of soap bars from neat soap which comprises the steps of:

a) preparing a neat soap comprising non-lauric fatty acid soaps having an iodine value of less than 45 and lauric fatty acid soaps, preferably such that the overall iodine value is less than 35, b) combining the product of step (a) with one or more synergistic mildness actives and superfatting agents and drying to obtain a blend comprising at least 5% wt on total actives of synergistic mildness active, 2–10% on total actives of free fatty acids, at least 25% wt on total actives of lauric acid soaps and 8–20wt % moisture, and, c) finishing the soap without energetic working to obtain soap bars.

* * * * *